US009716961B2

(12) United States Patent
Oellers et al.

(10) Patent No.: US 9,716,961 B2
(45) Date of Patent: Jul. 25, 2017

(54) WAVE FIELD SYNTHESIS SYSTEM

(71) Applicant: Advanced Acoustic SF GmbH, Potsdam (DE)

(72) Inventors: Helmut Oellers, Erfurt (DE); Frank Stefan Schmidt, Potsdam (DE)

(73) Assignee: Advanced Acoustic SF GmbH, Potsdam (DE)

( * ) Notice: Subject to any disclaimer, the term of this patent is extended or adjusted under 35 U.S.C. 154(b) by 0 days.

(21) Appl. No.: 14/911,388

(22) PCT Filed: Sep. 12, 2014

(86) PCT No.: PCT/IB2014/001806
§ 371 (c)(1),
(2) Date: Feb. 10, 2016

(87) PCT Pub. No.: WO2015/036845
PCT Pub. Date: Mar. 19, 2015

(65) Prior Publication Data

US 2016/0192103 A1 Jun. 30, 2016

(30) Foreign Application Priority Data

Aug. 10, 2013 (DE) ..... 10 2013 013 377

(51) Int. Cl.
*H04R 5/02* (2006.01)
*H04R 29/00* (2006.01)
(Continued)

(52) U.S. Cl.
CPC ..... *H04S 7/30* (2013.01); *H04R 5/02* (2013.01); *H04S 3/02* (2013.01);
(Continued)

(58) Field of Classification Search
CPC ..... H04S 7/39; H04S 3/02; H04S 2420/13; H04R 5/02; H04R 2430/01
(Continued)

(56) References Cited

U.S. PATENT DOCUMENTS

2012/0008812 A1* 1/2012 Sporer ..... H04R 1/26 381/335

FOREIGN PATENT DOCUMENTS

DE 10 2005 001 395 A1 8/2005
DE 10 2005 008 366 A1 8/2006
(Continued)

OTHER PUBLICATIONS

E. Corteel, Synthesis of Directional Sources Using Wave Field Synthesis, Possibilities, and Limitations, Eurasip Journal on Advances in Signal Processing, Nr. 1, Jan. 1, 2007.
(Continued)

*Primary Examiner* — Thjuan K Addy
(74) *Attorney, Agent, or Firm* — Dicke, Billig & Czaja, PLLC

(57) ABSTRACT

One example provides a decentrally structured apparatus including sound transducers and operating according to wave field synthesis principles. The decentrally structured apparatus includes a plurality of assembly units, each including several sound transducers, wherein the decentrally structured apparatus is configured to use a model-based approach to carry out a synthesis of wave fronts within each assembly unit for sound transducers of the respective assembly unit using audio signals and associated data for their form, and to actuate the sound transducers of the respective assembly unit with actuation signals corresponding to the synthesis.

11 Claims, 1 Drawing Sheet

(51) Int. Cl.
*H04S 7/00* (2006.01)
*H04S 3/02* (2006.01)

(52) U.S. Cl.
CPC ..... *H04R 2201/401* (2013.01); *H04S 7/302* (2013.01); *H04S 2420/13* (2013.01)

(58) Field of Classification Search
USPC ..... 381/303, 305, 58, 17, 335, 300
See application file for complete search history.

(56) References Cited

FOREIGN PATENT DOCUMENTS

| | | |
|---|---|---|
| EP | 1 622 842 A1 | 5/2006 |
| EP | 648 198 B1 | 8/2012 |

OTHER PUBLICATIONS

Karlheinz Brandenbrug, "Wave Field Synthesis: New Possibilities for Large-Scale Immersive Sound Reinforcement", Apr. 1, 2004.
A. J. Berkhout, "A Holographic Approach to Acoustic Control", Journal of the Audio Engineering Society, vol. 36, No. 12, Dec. 1988, pp. 977-995.
William Francis Wolcott IV, "Wave Field Synthesis with Real-Time Control", Future Work—Section 6.2, Sep. 2007.
John J. Neumann, Jr. , et al. "CMOS-MEMS Membrane for Audio-Frequency Acoustic Actuation", Electrical and Computer Engineering Dept., Carnegie Mellon University, Sep. 2001, pp. 236-239, XP-002240602.
Rene Rodigast, "3D Sound in the Fohhn SoundLab", Professional System, Apr. 2013 Jul./Aug.
Renato S. Pellegrini, et al., "Wave Field Synthesis with Synchronous distributed Signal Processing", IEEE 6th Workshop on Multimedia Signal Processing, 2004.
Stephan Mauer, et al. "Design and Realization of a Reference Loudspeaker Panel for Wave Field Synthesis", Presented at the 130th Convention, May 13-16, 2011.
Helmut Wittek, et al. "Spatial Sound Recording and Reproduction of the Future?", Institut Fuer Rundfunktechnik IRT, Wave Field Synthesis, 2002.
Helmut Wittek, IRT: Wave Field Synthesis, Fundamental Principles of the Wave Field Synthesis, Article of the VDT Magazine, Jun. 2004.
Prolight + Sound 2013, Fraunhofer Institute for Digital Media Technology, Apr. 4, 2013.
R. J. Geluk, "A Monitor System Based on Wave-Synthesis", AES, 96th Convention, Feb. 26-Mar. 1, 1994.

* cited by examiner

WAVE FIELD SYNTHESIS SYSTEM

CROSS REFERENCE TO RELATED APPLICATION

This Utility Patent Application claims priority under 35 U.S.C. §371 to International Application Serial No. PCT/IB2014/001806, filed Sep. 12, 2014, which claims the benefit of German Patent Application No. DE 10 2013 013 377.7, filed Aug. 10, 2013; which are both incorporated herein by reference.

The present invention refers to an apparatus comprising sound transducers based on the principle of wave field synthesis.

BACKGROUND OF THE INVENTION

It has been found that the wave field synthesis method for reproducing audio signals as first described in 1988 by Prof. Berkhout [1] can be used to physically reconstruct wave fronts originating from a natural sound source according to the Huygens principle. A virtual sound source is created at the location of the natural sound source from the elementary waves of a large number of individually activated sound transducers.

If these sound transducers are arranged on a two-dimensional surface, the principle of wave field synthesis creates the "acoustic curtain" phenomenon. In this area, all sound sources, and even the reflections of these sound sources can be physically reconstructed in all three spatial dimensions in the recording space, and the acoustics of the recording space is created.

In order to fully reconstruct the acoustic conditions in the recording space, it would be necessary to set up the acoustic curtain to surround the listener so that all reflections of the recording space can also be generated at their proper points of origin. In practice, however, it has not yet been proven possible to create such a "sound booth". The number of sound transducers would become very large, because they must be arranged close together to prevent the aliasing effects that would occur otherwise.

In practice, therefore, the wave field synthesis method is usually reduced to a horizontal row of sound transducers, which are arranged so as to surround the listener. This also has the effect of reducing the reproduction to this horizontal plane. Therefore, correct spatial playback is no longer possible. Moreover, the acoustics of the reproduction space must then be suppressed entirely due to the cylindrical propagation form of the wave fronts.

In the last few years several research facilities have successfully created a two-dimensional acoustic curtain. A solution, in which not all reflections but only the psychoacoustically significant direct wave fronts and the first, acoustically intensive reflections are reconstructed at their correct point of origin in the recording space, has been described in [3], according to which, in a model-based approach the sound transducers arranged to surround the listener are replaced with selectively generated reflections of the reproduction space.

However, it is also hardly feasible to position such an acoustic curtain directly in front of a listener if it is constructed as a single unit. It must be big enough to reproduce the direct wave fronts in its range. The cost of this would be enormous. Apart from this, it would be very difficult to transport it into the reproduction space as a fully assembly unit.

If several systems are coupled together, the computational complexity for wave field synthesis of a limited number of virtual sound sources with fixed positions is still manageable, even when constructing a two-dimensional acoustic curtain. But if a sound source moves in the recording space, all of the travel times and all levels of all of the reflections depending thereon must be recalculated for each individual sound transducer. The task of executing this operation for all sound transducers in an acoustic curtain fast enough to be able to continually represent such movement of a sound source approaches the current technological limits—even in the model-based approach of wave field synthesis and if only reflections of the first order are considered.

The computational complexity increases significantly if an attempt is made to represent a listener's change of location in the recording space. Then, all travel times of all direct wave fronts and of all reflections at every single sound transducer are also changed. The recalculated data would have to be read in at least eight times per second in order to be able to reflect a somewhat fluid movement [4].

Therefore, given the amount of computing power that is available, in the database-driven approach of wave field synthesis, researchers are resorting to calculating the pulse responses for each sound transducer for discrete source positions in advance and storing them, so that the virtual sound sources can then be rapidly shifted from one position to another [5].

However, rapid movements of the virtual sound source do not generate the Doppler effects that occur when a real sound source changes location.

DETAILED DESCRIPTION

Figure 1:
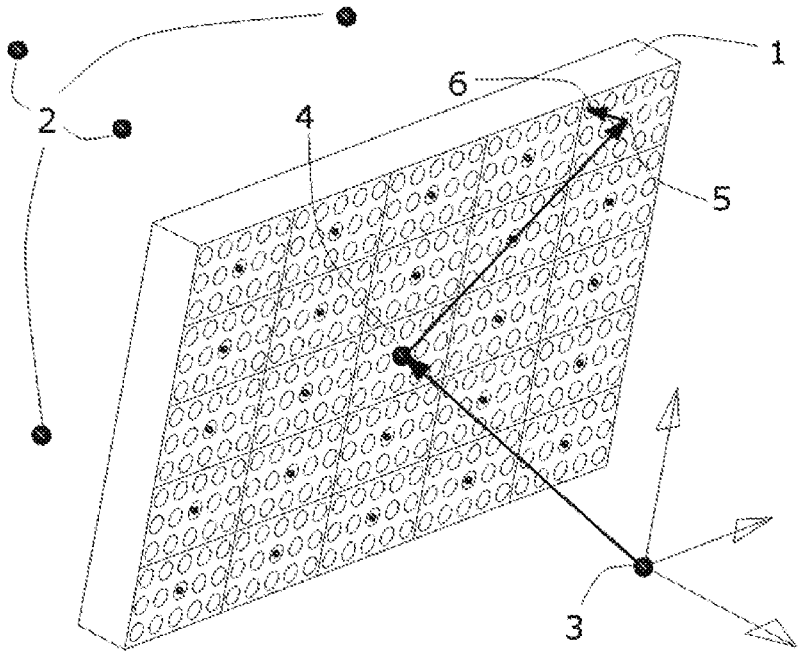
FIG. 1 illustrates one example of a modularly constructed apparatus having sound transducers.

Accordingly, the object the invention is to describe an apparatus which is transportable for practical reasons, and in which the computing power in the central processing unit does not increase in line with the number of sound transducers.

Further, it should also be possible to change the positions of the virtual sound sources quickly enough so that rapid movements of a sound source in three-dimensional space evoke the natural Doppler effects of a change of location of a real sound source.

The problems outlined in the preceding text, as well as others that may be inferred from the description, are solved by an apparatus having the features of claim 1. Further advantageous embodiments of the invention are described in the dependent claims. A preferred embodiment of the present invention is presented in the following drawings and a detailed description, but it is not intended that the present invention be limited thereby.

According to the invention, the apparatus consisting of sound transducers in accordance with the principle of wave field synthesis is to be constructed not as a closed unit, as described in [6] for example, but in a decentralised manner. The individual modules are typically not of identical design. A surrounding housing may enable a modular construction. This has the advantage that the modules are replaceable, and that they do not have to be allocated to a position in the coordinate system until the system is being set up. Moreover, they can be preassembled in groups and wired together in advance for live sound events, thus enabling the system to be set up very quickly.

All audio signals can then be distributed to each module along a common wire. Given the decentralised system architecture, a serial transmission protocol enables the data for delay times and levels to be transmitted very effectively also for each individual sound transducer when the model-based wave field synthesis approach is applied. All audio channels in the system are distributed to all modules in one data stream.

The size of additional data that have to be transmitted to the modules in a second data stream to enable calculating the signals for each individual sound transducer is comparatively small. According to the invention, the synthesis of content, that is to say the audio signals themselves, and form, the associated data, is then no longer carried out in a central processing unit, but autarchically in each modular unit. Due to the modular structure, differing data or single audio signals for each individual sound transducer do not have to be transmitted. The data stream transported from the central processing unit to all modules only contains the vector of each virtual sound source for reproduction to a single reference point in the system.

After the setup process, the vector of a reference point of the module concerned to this common reference point—the same in all modules—is known in the modules themselves, because it is compiled from the edge lengths of the module or assembly units and the position thereof in the arrangement of sound transducers. The vectors of each individual sound transducer to this reference point are then stored in the assembly unit or module itself. The exact position of the sound transducer in question relative to the coordinate origin of the system can be determined by adding the vector of the reference point of the sound transducer arrangement to the coordinate origin, the vector of the module reference point to the reference point of the sound transducer arrangement and the vector of the respective sound transducer to the reference point for the module.

In the model-based approach of wave field synthesis, the vector of each virtual sound source to the coordinate origin is also known. Accordingly, the distance between each virtual sound source and each sound transducer can be calculated within any module. This in turn can easily be used to determine the travel time of the sound from said virtual sound source to the sound transducer in question if the currently correct speed of sound is known, which depend on temperature of the propagation medium in front of the acoustic curtain.

The number of virtual sound source for representing the sources themselves and their acoustically intensive first reflections remains manageable in the model-based approach of wave field synthesis. Taking into account the directional resolution capability of human hearing, it is generally accepted that additional perceptible advantages are not gained if more than 32 separate positions can be represented by direct sound sources [7].

If only the first acoustically intensive reflections of these sources are synthesised correctly, seven virtual output points for virtual sound sources are generated for each audio channel. In the digital system, it is logical to reserve an eighth position for an additional acoustically intensive reflection.

Thus, the common data stream that is transmitted to the modules only carries 32×8=256 source positions for direct wave fronts and first acoustically intensive reflection as vector variables to the reference point of the sound transducer arrangement. For comparison purposes, if an acoustic curtain were set up completely in a unit, for example with 1024 individual sound transducers, 32×8×1024 output points of virtual sound source would have to be defined in all three spatial positions, that is to say 262144 vector variables. The data volume in a database-driven approach would be even greater. In this case, not only do the pulse responses contain the positions of the source and first acoustically intensive reflection, but all output points of all reflections are also restored in the convolution into the pulse response. It would only be possible to transmit this volume of data for many single positions of sound transducer on one line if a great deal of time were available for the transmission. But then rapid changes of location by the sound source could not be represented.

For this reason, the audio signals in the database-driven method of wave field synthesis are convoluted into the corresponding pulse responses in a central processing unit, and the output signal from this convolution is forwarded to the individual final amplifiers.

As the computing time of the central processing unit increases with the number of individual sound transducers grows, the principle of wave field synthesis was in the past almost always reduced to a single, horizontal row of sound transducers.

A fundamental advantage of the modular structure of the inventive arrangement of sound transducers that function according to the principle of wave field synthesis is that the computing work that has to be performed centrally and the volume of data that has to be transmitted to the modules are not dependent on the number of sound transducers in the system as a whole. It is not greater for an acoustic curtain of any size than for a single sound transducer.

This makes possible the representation of very fast movements by the sound source together with the associated position changes of its first acoustically intensive reflections in the model-based approach. The eight times three distance values of the central calculation amount to a data volume of just 576 bits for each sound source and its first acoustically intensive reflections, even with an extremely high, 24-bit resolution of the individual values. For 32 audio channels, this then yields a data rate of just 2,304 kByte for all position data. This value is so small that even the 8 updates per second required according to [6] in order to represent smooth movement of the source can easily be amply surpassed.

Due to the limited update capability of the source positions, it was previously common, even for the designs of wave field synthesis systems that were reduced to the horizontal plane, to define pulse responses for predefined source positions and save them in the system, so that the virtual sound source could then jump from one predefined position to another. As long as the source only jumps from one point to another, it is spatially fixed at each point, and in the event of a sudden change of position it is unavoidable that our ears very sensitively perceive artefacts, but not the natural Doppler effects of continuous motion.

But when the respective volume of data to be processed in the model-based approach of wave field synthesis is low—due to the distribution to individual modules—and the source positions are able to follow the natural location changes of the original sound sources and the first acoustically intensive reflections thereof very quickly, the representation of Doppler effects for moving virtual sound sources without artefacts is also possible, because a continuous movement of the virtual sound source in the room takes place.

The modular structure of the wave field synthesis system also provides another fundamental advantage. Since the quantity of the data to be transmitted and the computational complexity in the central processing unit are independent of the number of connected modules or assembly units, the system is freely scalable. This then makes it possible to dispense with the usual reduction of the method to the horizontal plane of the listener. Even very large acoustic curtains with directivities even for the bass range and narrowly focussed concave wave fronts can be created.

Even the "sound booth", which comes close to the theoretical wave field synthesis approach described in the Kirchhoff Helmholtz Integral for a complete physical reconstruction of the output sound field in a source-less volume, could be constructed because of the free scalability of the modular system.

In addition, it would also be possible to set up subsystems with different performance capabilities within the modular arrangement, to choose a greater distance between the sound transducers behind the listener, for example. The modules might also be combined to form a structure, a dice or cube for example, virtual sound sources are radiated outwards.

With the decentralised structure, it also becomes possible to actuate a very large number of very small sound transducers. In future, new perspectives in the application of MEMs [8] in conjunction with wave field systems may arise. The integrated sound transducers can be combined in large numbers on a common carrier base with other integrated components. This surface might then truly generate wave fronts like a curtain which is completely free from the aliasing effects that are unavoidable with the relatively large elementary waves of conventional sound transducers that differ from the theoretical approach of wave field synthesis.

Then again, groups of sound transducers might be formed on the component carriers, similarly to the modular construction, and powered by a distributed system made up of actuating units. In future, such microstructures might be used for the combined reproduction of auditory and visual information.

Figure 2:
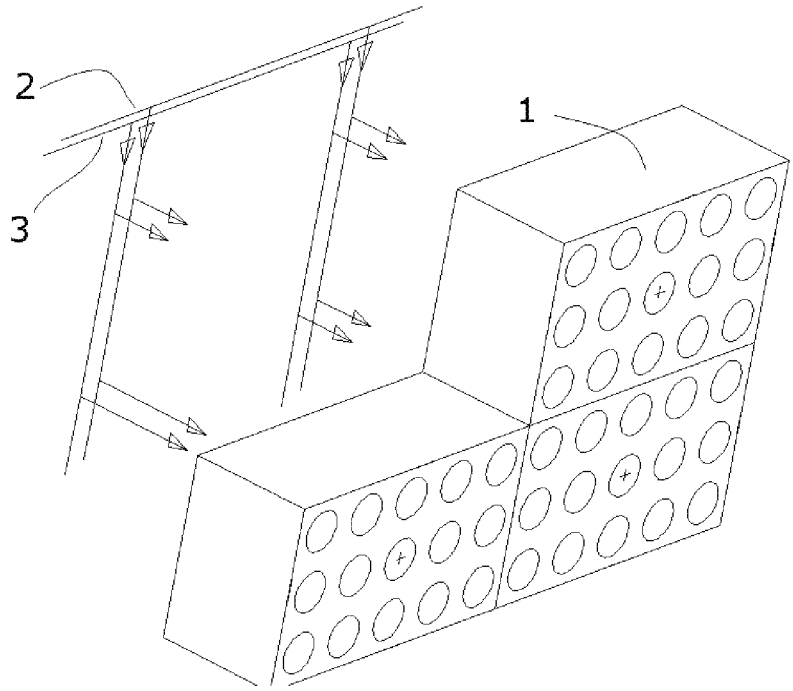
FIG. 2 is one example of a portion of the apparatus of FIG. 1, illustrating audio signals and data delivered to each module.

The apparatus is illustrated in FIGS. 1 and 2. It will be explained with reference to these figures.

FIG. 1 shows a modularly constructed apparatus consisting of sound transducers that function according to the principle of wave field synthesis (1). This apparatus is designed to represent virtual sound sources (2) whose position is defined in a coordinate system relative to the coordinate origin (3). The coordinate origin may be at the position of a listener in the reproduction space, but it may also be defined arbitrarily. In any case, the vector of a reference point (4) of the apparatus made from sound transducers to said coordinate origin has to be known. Then, the respective reference point in the individual modules (5) of the sound transducer apparatus is defined by the placement of the module in the system and the edge length of the modules. In the module, the position of each individual sound transducer (6) relative to each individual sound transducer is defined.

Since the positions of the virtual sound sources relative to the coordinate origin (3) and all vectors of the reference points up to and including every individual sound transducer in the coordinate system are known, the position of every single virtual sound source relative to every single sound transducer can be determined by adding the vectors together.

FIG. 2 illustrates that all audio signals and data are delivered to each module. This may be carried out via separate wires (1) and (2), or all information may also be transmitted to the modules via a common protocol. The volume of data is relatively small, because only the positions of the virtual sources in the coordinate system and their allocation to the audio signals are to be transmitted. Consequently, the positions can be updated at very short time intervals. For the small number of sound transducers in the module, the signals from all input sources, which are delayed and summed according to the position of the module in the arrangement of sound transducers, can be directed correspondingly rapidly to the corresponding end amplifiers.

With the apparatuses of sound transducers functioning according to the principle of wave field synthesis described herein for reproducing sound events, it is not necessary to have recourse to the psychoacoustically dependent formation of phantom sound source between loudspeakers, but the sound field is rather physically reconstructed. From the audio signal itself (content) and data regarding its Gestalt or structure (form), wave fronts are reconstructed from elementary waves using Huygens' principle. Virtual sound sources are created, which are physically no different from the wave front of the real sound source.

In this context, the audio signal is convoluted into the spatial pulse response of the recording space in a renderer for each elementary wave on the playback side [2].

To ensure correct reproduction, the output points of the elementary waves should be positioned close to each other. The virtual sound sources can only arise in the vicinity of the sound transducer arrangement. Therefore, there should be a very large number of them when a two-dimensional sound transducer surface is being constructed Consequently, the demands imposed on the renderers of previously known systems are increased, and the actuation of a large number of sound transducers entails a great deal of computational complexity. In practices, this is why the principle of wave field synthesis was typically reduced to a horizontal row of sound transducers. In these systems, wave field synthesis is usually reduced to the horizontal plane of the listener, the third dimension is lost when sound events are reproduced.

With the solution according to the invention, however, the necessary computing power can be decentralised, because the quantity of data that must be transmitted between the subsystems does not increase with the number of sound transducers. Consequently, the system is freely scalable.

This makes it possible to create two-dimensional devices of any size consisting of sound transducers that operate according to the principle of wave field synthesis, which are able to reproduce rapid location changes by the virtual sound sources with the associated Doppler effects but without artefacts.

According to one embodiment of a decentrally (con) structured apparatus of sound transducers that operate according to the principle of wave field synthesis, the wave fronts are synthesised in the respective modules from the audio signals and the associated data for the sound transducers that are contained in individual modules, wherein the geometrical position of a reference point within the coordinate system for the model-based approach of wave field synthesis is determined for each individual module by its positioning in the sound transducer arrangement and the edge length of the individual module, and the position of each individual sound transducer in this coordinate system is defined by its arrangement relative to this reference point, with the result that the position of every single sound transducer in the coordinate system can be deduced simply from the position of the module in the arrangement of sound transducers by adding the vector to the higher level reference point in each case.

According to a further development, the modules are enclosed in a module housing, or are formed from identically sized segments in a structure of components.

The arrangement of sound transducers is typically freely scalable in terms of size, because the computational complexity that is carried out in the central processing unit does not increase with the number of sound transducers in the system.

According to yet another further development, all audio signals and the data for synthesising the wave modules are delivered to all modules in the apparatus, and the data derived from the position of the respective module within the sound transducer arrangement are processed in each module.

The position of the individual sound transducers within a module relative to a fixed reference point of the module is typically stored in the module.

According to yet another further development, the position of a fixed reference point for each assembly unit is calculated relative to the position of a reference point of the sound transducer apparatus by communicating to the assembly unit the position in which it was installed in the sound transducer apparatus, and that it is able to deduce from this the position of its reference point relative to the central reference point of the apparatus of sound transducers using the saved dimensions of the individual assembly units, which may also be designed as modules.

According to yet another further development, the density with which the assembly units are provided with sound transducers varies. In this way, it is possible to reduce the complexity in the reproduction ranges that are less significant for human perception of sound events.

The assembly units may be constructed in closed plane, and/or a closed row.

But the assembly units may also be constructed so that they are not arranged in a closed plane or a closed row.

According to yet another further development, the sound transducers are allocated to partial surfaces, which may form a structure, which is able to radiate the wave fronts in different directions in a common system.

According to yet another further development, a system for image reproduction is also mounted on the same carrier system as the one supporting the sound transducers.

According to yet another further development, the assembly units or modules are combined into prefabricated units. This enables the system to be set up more quickly.

According to another embodiment, the decentrally constructed apparatus of sound transducers operating according to the principle of wave field synthesis includes a plurality of assembly units, each of which includes a plurality of sound transducers and one module controller, wherein each module controller is designed to be able to generate actuation signals for the sound transducers in its assembly unit from audio signals and associated data for the form for synthesising the wave fronts.

This construction also makes it possible for an image reproduction system to be mounted on the same carrier system as the one supporting the sound transducers.

The features of the various embodiments described in this document can also be combined with each other.

LIST OF REFERENCES

[1] Berkhout, A. J. (1988): A holographic approach to acoustic control. Journal of the Audio Engineering Society, Vol. 36, No. 12, December 1988, pp. 977-995.

[2] http://www.hauptmikrofon.de/theile/WFS Theile VDT-Magazin 2 2005.pdf

[3] DE 10 2005 001 395 A1

[4] William Francis Wolcott IV: Wave Field Synthesis with Real-time Control

[5] Dipl. Ing (FH) Rene Rodigast, Frauenhofer-Institut für Digitale Medientechnologie IDMT: Sprachwiedergabe oder Konzertakustik-Akustische Raumsimulation in der 3D-Beschallung, 8.0 E 37 Messe Frankfurt/Prolight+Sound 2013

[6]http://iosono-sound.com/assets/files/IOSONO IPC100 brochure.pdf

[7] http://wfsynth.sourceforge.net/Thesis.pdf

[8] John J. Neumann, Jr. and Kaigham J. Gabriel, CMOS-MEMS Membrane for Audio-Frequency Acoustic Acuation, Electrical and Computer Engineering Dept., Carnegie Mellon University, 2001, pp. 236-239, XP-002240602.

What is claimed is:

1. A decentrally structured apparatus comprising sound transducers and operable according to the principle of wave field synthesis, the apparatus comprising:

a plurality of assembly units, each of the assembly units comprising several sound transducers and a module controller; and wherein each of the module controllers is configured to use a model-based approach to carry out a synthesis of the wave fronts for the sound transducers of the respective assembly unit using audio signals and associated data for their form, and to actuate the sound transducers within the respective assembly unit with actuation signals corresponding to the synthesis.

2. The decentrally structured apparatus according to claim 1, wherein the geometrical position of a reference point of the assembly unit is determined within a coordinate system for the model-based approach of wave field synthesis for each individual assembly unit by its position in the arrangement of sound transducers and the edge length of the individual assembly units, and/or wherein the geometrical position of each individual sound transducer is defined in this coordinate system by its arrangement relative to this reference point of the assembly unit, so that the position of each individual sound transducer in the coordinate system can be determined simply from the arrangement of the assembly units in the apparatus of sound transducers by the addition of vectors to the respective reference point.

3. The decentrally structured apparatus according to claim 1, wherein each of the assembly units is surrounded by a respective module housing and/or that the assembly units are formed from segments of the same size in a structure of components.

4. The decentrally structured apparatus according to claim 1, wherein the size of the arrangement of sound transducers is freely scalable.

5. The decentrally structured apparatus according to claim 1, wherein all audio signals and the associated data for the synthesis of the wave fronts are delivered to all assembly units of the apparatus, wherein each assembly unit processes the associated data derived from the position of the respective assembly unit within the arrangement of sound transducers.

6. The decentrally structured apparatus according to claim 1, wherein the positions of the individual sound transducers within an assembly unit relative to a fixed reference point of the assembly unit is stored in the assembly unit.

7. The decentrally structured apparatus according to claim 1, wherein the position of a fixed reference point of each assembly unit relative to the position of a reference point of the apparatus of sound transducers can be determined by communicating to each of the assembly units the position in which it was installed in the sound transducer apparatus, and that each of the assembly units is able to determine the position of its reference point relative to a central reference point of the apparatus of sound transducers using the position in which it was installed and stored dimensions of the individual assembly units, which may also be designed as modules.

8. The decentrally structured apparatus according to claim 1, wherein a density with which the assembly units are equipped with sound transducers varies.

9. The decentrally structured apparatus according to claim 1, wherein the assembly units can also be arranged in a non-closed plane or a non-closed row.

10. The decentrally structured apparatus according to claim 1, wherein the sound transducers can be allocated to partial surfaces, which can radiate each of the wave fronts in a different direction.

11. The decentrally structured apparatus according to claim 1, wherein assembly units or modules are combined to form prefabricated units.

* * * * *